US007661907B2

(12) United States Patent
Armstrong

(10) Patent No.: US 7,661,907 B2
(45) Date of Patent: Feb. 16, 2010

(54) GROUND ENGINEERING METHOD

(75) Inventor: Andrew William Armstrong, Maldon (GB)

(73) Assignee: AQS Holdings Limited (GB)

( * ) Notice: Subject to any disclaimer, the term of this patent is extended or adjusted under 35 U.S.C. 154(b) by 0 days.

(21) Appl. No.: 12/227,101

(22) PCT Filed: May 1, 2007

(86) PCT No.: PCT/GB2007/050228

§ 371 (c)(1),
(2), (4) Date: Nov. 6, 2008

(87) PCT Pub. No.: WO2007/129112

PCT Pub. Date: Nov. 15, 2007

(65) Prior Publication Data

US 2009/0110489 A1 Apr. 30, 2009

(30) Foreign Application Priority Data

May 8, 2006 (GB) ..... 0608901.5

(51) Int. Cl.
*E02D 3/02* (2006.01)
*E02D 3/11* (2006.01)

(52) U.S. Cl. ..... 405/271; 405/128.6; 405/131

(58) Field of Classification Search ..... 405/128.6, 405/130, 131, 258.1, 271
See application file for complete search history.

(56) References Cited

U.S. PATENT DOCUMENTS

| | | | |
|---|---|---|---|
| 3,898,844 | A | 8/1975 | Menard et al. |
| 4,662,792 | A | 5/1987 | Gessay et al. |

FOREIGN PATENT DOCUMENTS

| | | |
|---|---|---|
| DE | 3936351 | 5/1991 |
| DE | 10023189 | 10/2001 |
| FR | 2292681 | 6/1976 |
| FR | 0443960 | 8/1991 |
| GB | 1583425 | 1/1981 |
| JP | 59096321 | 6/1984 |
| JP | 63138014 | 6/1988 |
| JP | 2005 076414 | 3/2005 |
| WO | WO 96/27713 | 9/1996 |
| WO | WO 2004/005626 | 1/2004 |

OTHER PUBLICATIONS

One International Search Report.
One UK International Search Report.

*Primary Examiner*—Tara Mayo-Pinnock
(74) *Attorney, Agent, or Firm*—Renner, Kenner, Greive, Bobak, Taylor & Weber

(57) ABSTRACT

A method of modifying geotechnically unsuitable soils at a site involving soil stabilization treatment and rolling dynamic compaction. A portion of the site is excavated to a predetermined depth x. Both the excavated site and the soil excavated therefrom are subjected to soils stabilization treatments before the treated excavated soils is backfilled in layers and subjected to both standard compaction and rolling dynamic compaction.

16 Claims, 4 Drawing Sheets

GROUND ENGINEERING METHOD

This invention relates to a ground engineering method. In particular, it relates to a method for modifying geotechnically unsuitable soils at a site so as to render the site capable of load bearing.

Traditionally, when undertaking construction work at site with geotechnically unsuitable soils (i.e. soils incapable of bearing substantial loads or stresses due), a number of possible solutions exist, which can be selected to attempt to overcome the issue. Such conventional solutions include the use of structural fill (also known as "dig and dump"), bypassing the area of geotechnically unsuitable soils by piling, pre-loading the ground, or designing the structure to be built so as to minimize the effect on the ground.

In conventional piling techniques, piles are driven into the ground, down to strata with load-bearing capabilities. The depth of piling required can vary considerably in depth, as the principle behind this solution is to transfer the load imparted by a building constructed on the site via the piles to the underlying strata. The upper layers of weaker soil which are incapable of supporting either the building load or the pile stresses are therefore effectively by-passed Piling is however a time consuming, labor intensive, and costly procedure which moreover does not necessarily alleviate all of the problems presented by the presence of geotechnically unsuitable soils. In particular, because the weaker upper layers of soil are left unchanged, they continue to exhibit undesirable properties—most notably in the case of clay soils the tendency to expand and contract in the presence or absence of water, and in the case of soils having air pockets or 'voids' therein, the tendency to settle. Because the geotechnically unsuitable soil layers are not uniform, such expansion, contraction and settlement may occur to differing degrees across a site. This leads to differential settlement of the site, which can ultimately lead to subsidence in the foundations of the buildings constructed thereon, causing cracks in masonry, and damage to drains and other subterranean infrastructure.

Where the condition of the soil at a site is marginal, alternatives to piling have been proposed, directed to modifying the properties of the geotechnically unsuitable and marginal soils so as to render them capable of bearing a load. These proposed alternatives centre around two basic principles: consolidation, which requires the removal of water from the soils; and compaction, which requires the removal of air from the soils.

Consolidation of marginal soils, has been carried out in one form or another for many years, and is embodied in the process of soil stabilization. Soil stabilization is primarily used to dry out material which is too wet, and to modify chemically the make-up of the soils to enhance their weight-bearing capabilities. This process typically involves treating a hydrated clay soil with an anhydrous material such as lime, so as to reduce the water content of the soil, and to initiate a chemical reaction resulting in modification of the chemical structure of the soil so as to remove its capacity to shrink or heave in the future. Ultimately, this can enable the soil to be modified so as to exhibit granular rather than cohesive properties.

Compaction requires the physical application of a load to the ground, so as to force the soil particles closer together, thereby expelling air. A number of compaction techniques are available, the type selected being determined by the depth of influence required.

Standard compaction techniques involve mechanically driving a cylindrical roller over an area of ground so as continuously to compact the soil layers therebeneath.

Dynamic compaction (DC) improves the mechanical properties of the soil by repeated application of very high intensity impacts to the surface, achieved by dropping a weight across the surface to be compacted. The effective depth of the treatment will be determined by the magnitude of the weight and the height of the drop. Dynamic compaction has been found to have an influence on soils in excess of 20 m below ground level. The type of dynamic compaction selected will depend on the geotechnical conditions to be addressed.

A variation of this technique, known as rolling dynamic compaction (RDC) has been developed, in which a roller having a non-circular cross-section is used. RDC rollers have been developed having generally polygonal cross-sections with 3, 4, or 5 sides. The principle behind rolling dynamic compaction is that as the non-circular roller is driven across the ground and caused to rotate, one apex after another will be raised to a zenith, thus effectively gaining potential energy, before being released by compression springs to fall under gravity. The potential energy is thus converted into kinetic energy, which in turn is transferred to the soil when the apex reaches the lowest point of its cycle upon impact with the surface of the ground.

Rolling dynamic compaction is capable of delivering significantly greater loads to the soil than dead weight or vibrating compaction, due to the height and weight multiplier factor which is inherent in its design. As a result, whilst other compaction methods are capable of delivering a high degree of compaction to soil layers near the surface of the ground, rolling dynamic compaction has been found to achieve compaction of soils in excess of 5 m below the surface.

Both soil stabilization and rolling dynamic compaction produce satisfactory results in modifying marginal soils, though the processes work in substantially different ways. However, in situations where the soil at a site is geotechnically unsuitable, neither soil stabilization nor rolling dynamic compaction alone can modify the soil properties to such a degree that piling is no longer required. Instead, so-called "dig and dump" techniques must be utilized, in which the geotechnically unsuitable soil is excavated, removed from the site, and disposed of. Dig and dump techniques are undesirable due to their environmental impact both in terms of lorry movements and use of landfill sites, as well as being costly, time consuming and labor intensive.

Hitherto, no single method has been developed which is capable of modifying geotechnically unsuitable soils to such a degree that the need for piling is disposed of altogether. Furthermore until now, the prevailing conventional wisdom within the construction industry has held that the effects of soil stabilization and rolling dynamic compaction are competing processes which cannot be utilized in tandem.

The present invention stems from the realization that, contrary to the beliefs of many within the construction industry, the techniques of soil stabilization and rolling dynamic compaction can be adapted to work together in synergy. The present invention therefore seeks to combine these two traditionally disparate techniques in a single ground engineering method, whereby geotechnically unsuitable soils are modified so as to render them capable of load bearing. The present invention further seeks substantially to reduce or eliminate the need for piling and "dig and dump" techniques to be carried out at sites comprising geotechnically unsuitable soils. This will result in construction projects benefiting from significant cost savings, shorter construction times and reduced environmental impact. The present invention further seeks to deliver a method whereby a geotechnically unsuitable site is modified such that the risk of differential settlement following construction on the site is substantially reduced or eliminated.

According to the present invention, there is provided a method of modifying geotechnically unsuitable soils at a site so as to render the site capable of load bearing, said method comprising steps of soil stabilization and rolling dynamic compaction.

The present invention is not limited to the application of any particular theory or hypothesis. However, it is believed that the synergistic effect observed when combining soil stabilization and rolling dynamic compaction according to the method of the present invention, results from the soil stabilization processes breaking down the structure of the soil, thus enabling the rolling dynamic compaction step(s) to expel air and water, thus causing compaction and consolidation. It is also believed that soil stabilization improves the soil strength, so that more dynamic force can be applied during rolling dynamic compaction, thereby increasing the compaction and consolidation effect. In order to achieve this synergistic effect however, the soil stabilization process must be adapted from conventional treatments—that is to say, the soils must be modified in excess of normal techniques, and in particular must have a moisture content of less than the standard optimum moisture content.

Preferably, the method of the present invention is performed according to a sequence comprising the following steps:

(a) excavating a volume of soil from the site, to a predetermined depth;
(b) applying an in situ soil stabilization treatment to the base of the excavated site exposed in step (a);
(c) applying a soil stabilization treatment to the volume of soil excavated from the site in step (a);
(d) applying rolling dynamic compaction to the base of the excavated site exposed in step (a);
(e) re-introducing into the excavated site a portion of the treated soil from step (c) so as to form a layer of predetermined thickness;
(f) applying compaction to the layer formed in step (e);
(g) iterating steps (e) and (f) to form a compound layer of pre-determined thickness;
(h) applying rolling dynamic compaction to the compound layer formed in step (g); and
(j) iterating steps (e) to (h) so as substantially to backfill the site to a pre-determined level.

The soil stabilization treatments in steps (b) and (c) preferably involve treating the soil with one or more powder or binder materials selected from cement, lime (calcium oxide), pulverized fuel ash (PFA) and ground granulated blast-furnace slag (GGBS). The powder or binder materials are preferably selected so as to provide autogenous 'healing' properties, to enable the soil to recover its strength after the application of RDC.

The use of lime is particularly preferred, since anhydrous calcium oxide reacts with the water of hydration in the soil so as effectively to remove water from the soil, according to the following exothermic reaction, in which the heat produced also causes further drying of the soil by evaporation:

$$CaO+H_2O \rightarrow Ca(OH)_2$$

In the in situ soil stabilisation treatment in step (b), the calcium oxide is preferably mixed into the soil at the base of the excavated site by rotavation, to a depth of substantially 300 mm. The soil stabilisation treatment applied to the excavated soil in step (c) also preferably includes a step of mixing the calcium oxide with the excavated soil.

The soil stabilisation treatments in steps (b) and (c) are preferably continued until the moisture content of the treated soil is reduced to substantially 3% less than the standard optimum moisture content for the type of soil being treated.

The rolling dynamic compaction treatment carried out in steps (d) and (h) may be performed with any suitable construction of RDC roller, however it is currently preferred to use a 4-sided, 8 or 12-tonne roller for this treatment. Rolling dynamic compaction is preferably continued until effective refusal is achieved (i.e. until no further compaction of the underlying ground is possible). In practice, this is likely to be achieved after in the range of 20 to 40 passes of the RDC roller for the base layer in step (d) and after 20 passes for the compound layers in step (h).

The compaction applied in step (f) need not be rolling dynamic compaction, since only the individual layers of backfilled material are required to be compacted in this step, rather than compacting areas deeper below the site surface, as in steps (d) and (h). The required zone of compaction influence is in step (f) is therefore typically only in the range of from 300 to 600 mm. Preferably therefore, compaction with a vibrating cylindrical roller is utilized in step (f), and is continued until substantially 95% compaction of the layer formed in step (e) is achieved, as measured by the Proctor dry density test.

The method of the present invention eliminates the need for costly or environmentally unsound techniques such as piling or 'dig and dump' at a site comprising geotechnically unsuitable soils, by excavating, modifying, backfilling, compacting and consolidating the soils. The resultant backfilled site then comprises a system of re-engineered soils, which, in addition to exhibiting load-bearing capabilities sufficient to allow construction on the site, also effectively acts as a single mass due to the extensive consolidation and compaction. This effectively eliminates the risk of differential settlement, and hence subsidence, at the site.

The re-engineering of the site so as to produce a consolidated and compacted mass makes the method of the present invention particularly applicable to sites comprising expansive clay soils. In this situation, the soil stabilization steps (b) and (c) preferably include soil modification treatment so as to prevent the subsequent swelling and contraction of the clay soils in the presence of water.

In a variation of the method of the present invention, an additional step is included, between steps (d) and (e), whereby there is introduced into the excavated site an additional layer having pipes for connection to a geothermal heating system.

In order that the present invention may be more fully understood, a preferred embodiment thereof will now be discussed in detail, though only by way of example, with reference to the following drawings in which.

Figure 1:
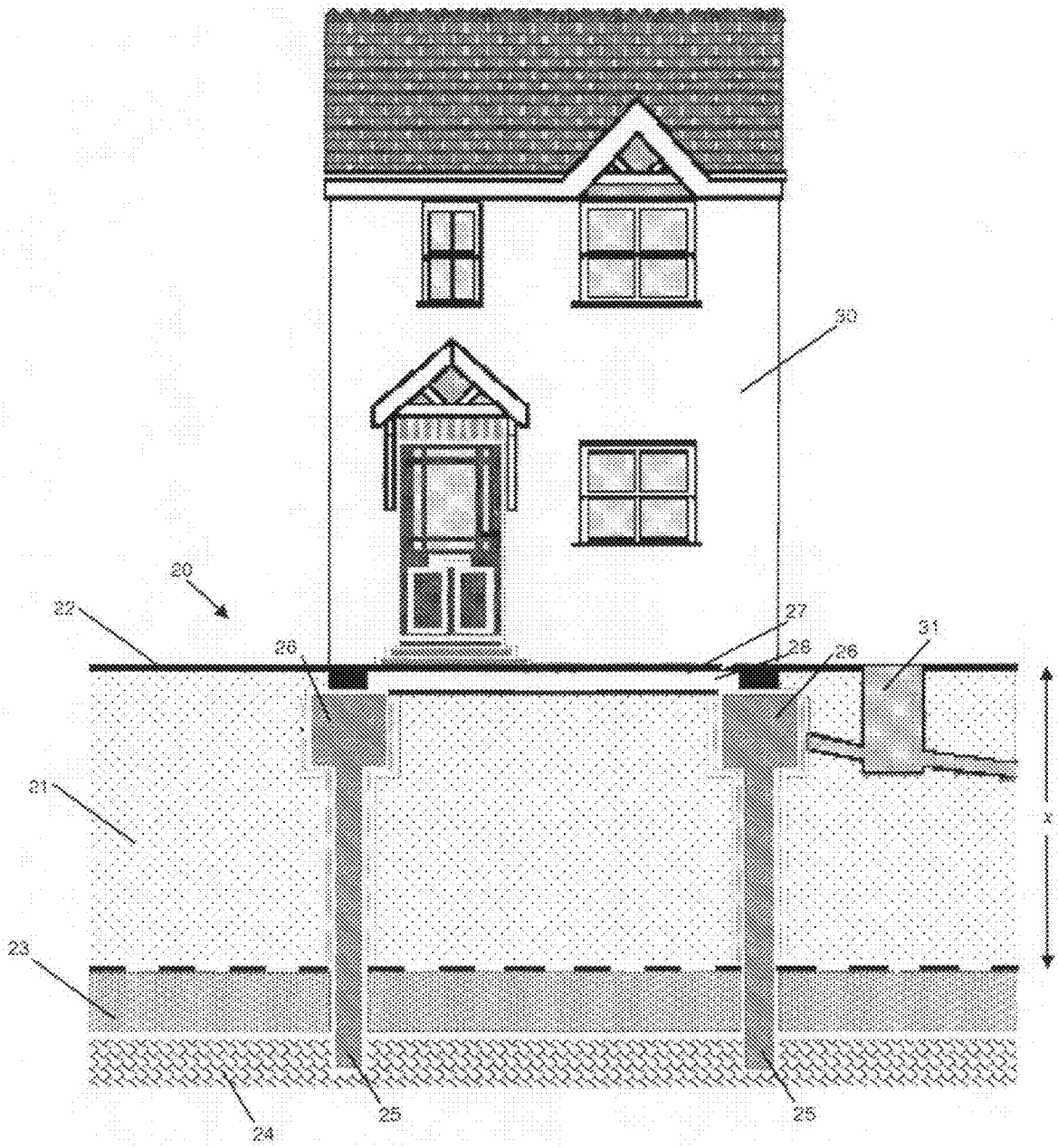
Figure 1 (prior art)
FIG. 1 is a schematic, cross-sectional representation of a site comprising geotechnically unsuitable soils, having a building constructed thereon using a conventional piling technique.

Referring first to FIG. 1, there is shown a site, generally indicated 20 in which the upper strata 21, immediately beneath the surface 22 of the ground, comprises geotechnically unsuitable or weak soils, down to a depth x of around 3 m. Beneath the upper strata 21 is a natural ground strata 23, which although potentially geotechnically superior to the upper strata 21 is similarly incapable of supporting the stresses incurred in the piling technique illustrated in FIG. 1. Underlying the natural ground strata 23 is a load-bearing strata 24 to which any load resultant from construction on the site 20 must be transferred in order to achieve stability.

As can be seen from FIG. 1, in conventional piling techniques, piles 25 are driven down through the upper strata of geotechnically unsuitable soils 21, through the intermediary natural ground strata 23 and into the load-bearing strata 24. At the upper ends of the piles 25 are formed reinforced concrete beams 26 upon which is constructed a suspended floor 27 having an integral void 28 therewithin. A building 30 is then constructed upon the suspended floor 27.

The reinforced concrete beams 26 and piles 25 serve to transfer the load imparted by the building 30 to the load-bearing strata 24, effectively by-passing the upper strata of geotechnically unsuitable soils 21, and the intermediary natural ground strata 23. However, since drainage and paving 31 is located in the zone of geotechnically unsuitable soils 21, it must be formed with a flexible construction so as to account for any differential settlement, expansion or contraction of the upper strata 21.

Figure 2:
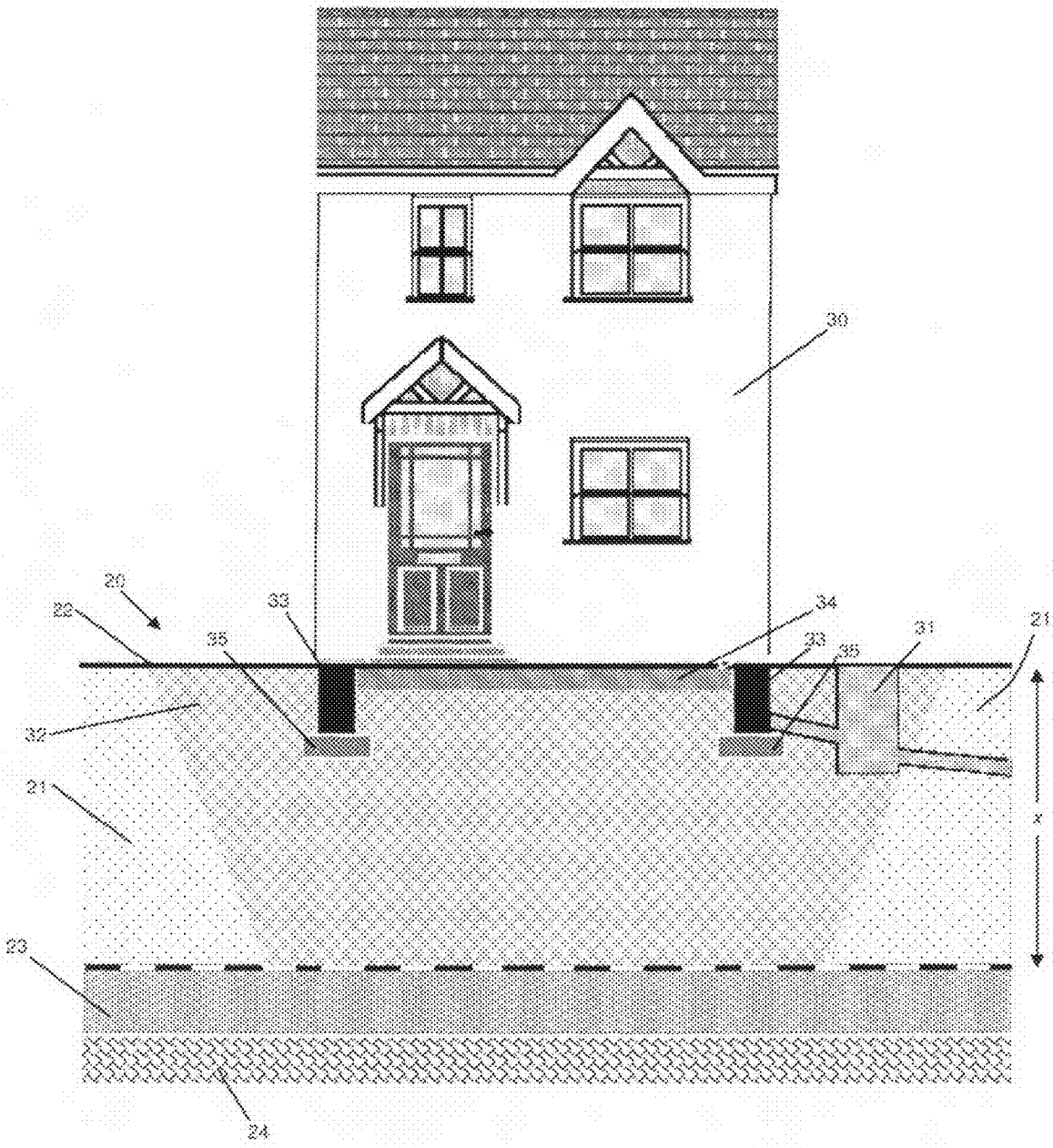
FIG. 2 is a schematic, cross-sectional representation of an equivalent site comprising geotechnically unsuitable soils, but which has been modified according to the method of the present invention.

Referring now to FIG. 2, there is shown an essentially identical basic site 20, comprising the same three strata as in FIG. 1, namely: an upper strata of geotechnically unsuitable soils 21, an intermediary natural ground strata 23 and a deep underlying load bearing strata 24. However, in FIG. 2, the site 20 has been re-engineered according to the method of the present invention, so as to eliminate the need for piling.

As can be seen in FIG. 2, a section of the upper strata 21 has been excavated, modified, backfilled, consolidated and compacted to form a 'raft' 32 of re-engineered soils capable of supporting the required bearing pressure attributable to traditional foundations 33, such as would be used at a site comprising geotechnically sound soils. An important factor in the example shown in FIG. 2 is that the intermediary natural ground strata 23 is capable of supporting the required bearing pressure attributable to the raft 32 of re-engineered soils, whereas the same strata 23 is incapable of supporting the pile stresses resultant from conventional piling techniques as illustrated in FIG. 1. This is because the method of the present invention enables the load imparted by the building 30 to be dissipated over a large area of the site 20, rather than concentrated at specific points, as with the conventional piling technique illustrated in FIG. 1.

The method of the present invention eliminates the need for reinforced concrete beams 26 and piles 25 and instead allows the building 30 to be constructed on traditional foundations 33 incorporating a stone slab 34 and strip footings 35 set into the raft 32 of re-engineered soils. Since the drainage and paving 31 are now located within the raft 32 rather than in the surrounding zone of geotechnically unsuitable soils 21, they can now be formed with a fixed, rather than a flexible, construction. The raft 32 of re-engineered soils will exhibit uniform properties of settlement, expansion and contraction, thus effectively eliminating the risk of subsidence.

Figure 3:
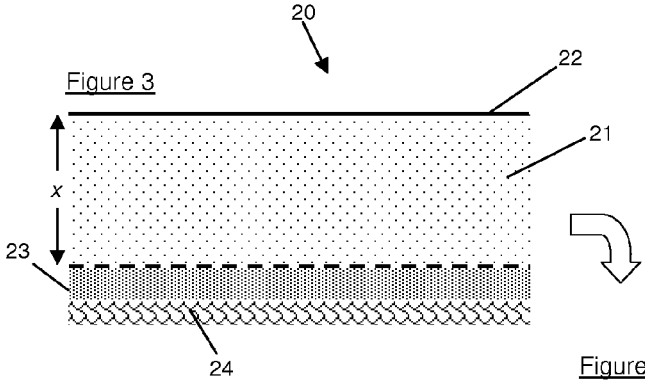
FIGS. 3 to 11 form an illustrative sequence depicting a method for modifying geotechnically unsuitable soils according to the present invention.

An example of the method of the present invention will now be described with reference to FIGS. 3 to 11. Referring first to FIG. 3, this shows the site 20 in its original condition, before being re-engineered according to the method of the present invention. The site 20 comprises an upper strata of geotechnically unsuitable soils 21 immediately beneath the surface 22, an intermediary strata of natural ground 23 incapable of bearing normal stresses associated with conventional piling techniques, and a deep strata 24 having load-bearing capabilities.

The method of the present invention begins with the preliminary steps of: (i) investigating the site to determine the characteristics of the soils in the various strata 21, 23, 24; and (ii) determining the building load and design requirements. From the data acquired in these steps a further preliminary step (iii) is carried out, in which the parameters of the ensuing process are determined. These parameters included the required excavation depth x, the required composition of the soil stabilization treatment formulations, the required individual backfill layer thickness, the required compound layer thickness, and the required backfill level, as will be described in more detail below.

Figure 4:
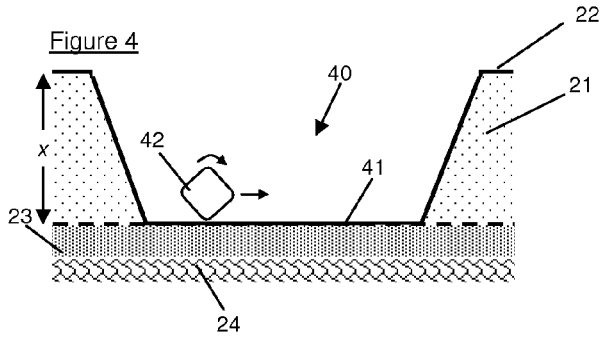

Referring now to FIG. 4, the main part of the method of the present invention commences with a step (a) of excavating a volume of geotechnically unsuitable soil from the upper strata 21 of the site 20, down to a depth x as determined in preliminary step (iii). The excavation depth x is generally around 3 m. The excavated soil (not shown) is not removed from the site 20 for disposal, but rather is retained for soil stabilization treatment, following which it will be used to backfill the excavated site 40, as will be described in more detail below. This aspect of the present invention alone represents a major cost saving, and a major reduction in environmental impact, due to the reduction in lorry movements which would normally be required when using a conventional 'dig and dump' process.

The excavation of the site 40 in this way also provides a number of further opportunities which may be incorporated into the method of the present invention. For example, any contaminated materials identified during the preliminary site investigation step (i) can be modified to make them safe from leaching, and then buried at the bottom 41 of the excavated site, away from possible human contact, and isolated from drainage and other services. Another option is the incorporation of pipes (not shown) for a geothermal heating system, which can be incorporated at the base 41 of the excavated site, i.e. at a depth x of around 3 m. This is particularly advantageous since the depth of installation is key to the efficiency of such systems, whilst the pipes would also be protected deep under the building 30, away from other services and infrastructure.

After each main method step, a supplementary step (iv) is carried out, wherein the condition of the soil is tested and monitored so as to ascertain and verify the extent of consolidation and compaction.

Following excavation of the site 40, method steps (b) and (c) are performed, wherein soil stabilization treatments are applied, respectively, to the newly exposed base surface 41 at the bottom of the excavated site 40, and to the volume of soil excavated from the site 40. Both steps involve treating the soil with a formulation comprising calcium oxide or other suitable binders, and mixing said formulation into the soil.

Having applied the soil stabilization treatment to the exposed base surface 41 in step (b), the exposed base surface 41 is then subjected to rolling dynamic compaction (RDC) in step (d), using a four-sided RDC roller 42, as represented schematically in FIG. 4. This ensures that the strata 23 immediately beneath the excavated site 40 is consolidated and compacted to the required degree. The Application of RDC proves out the base 41 by identifying any soft spots, and utilizes the synergistic properties of stabilization and dynamic compaction as the soft spots identified are dug our and replaced with suitably modified material. To aid the consolidation process, the base 41 is over-dried such that the base layer 41 then acts as a capillary to absorb any moisture generated from the RDC process. However, if the base surface 41 deteriorates during the RDC process, then the soil stabilization step (b) must be repeated. Following the RDC process, compaction to the top 300 mm of the base layer 41 is carried out using a vibrating cylindrical roller 45.

Figure 5:
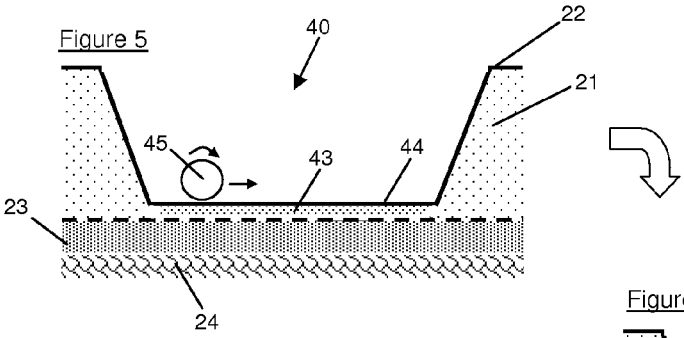

Referring now to FIG. 5, this illustrates the subsequent step (e) of re-introducing into the excavated site 40 a portion of the soil which was excavated from the site 40 in step (a) and treated in step (c). The re-introduced treated soil forms a layer 43, of generally around 200 to 300 mm thickness. The top of the re-introduced soil layer 43 forms a new exposed surface 44, which is then subject to standard compaction in step (f) using a cylindrical roller 45, as represented schematically in FIG. 5.

Figure 6:
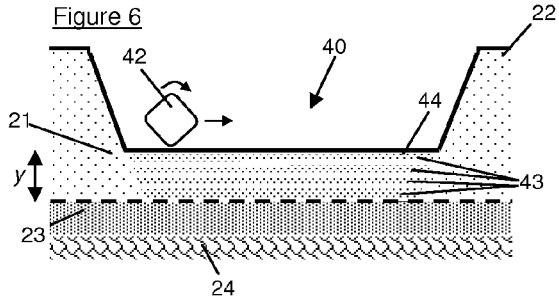

The next step (g) of the method involves repeating steps (e) and (f) of forming layers 43 of re-introduced treated soil and applying standard compaction 45 to the newly exposed surface 44. This cycle is repeated until the total depth of the formed layers 43 reaches a pre-determined thickness y, generally in the range of from 1.0 to 1.5 m, as shown in FIG. 6.

Figure 7:
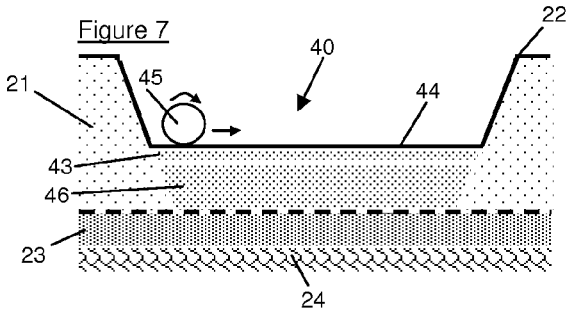
Figure 8:
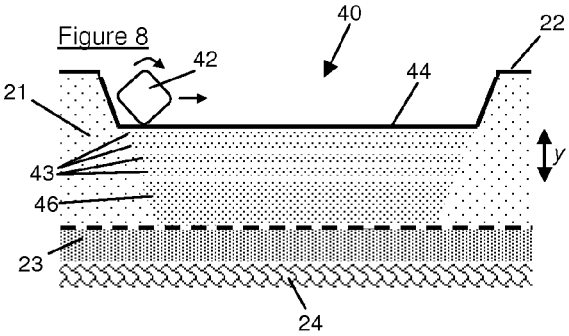
Figure 9:
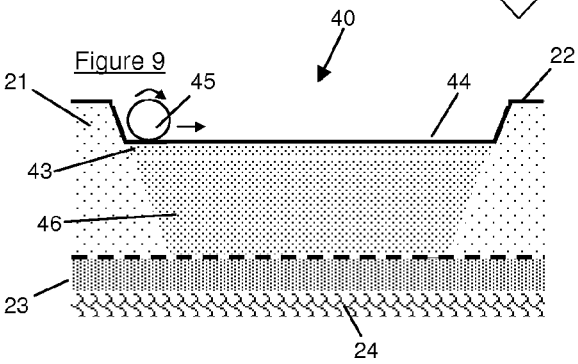

The multiple layers 43 are then subjected to a step (h) of applying rolling dynamic compaction 42 to the newly formed exposed surface 44 so as to form a compound layer 46, as can be seen in FIG. 7. The RDC process in step (h) proves out the compound layer 46 in the same way as described above for step (d) with reference to FIG. 4.

Figure 10:
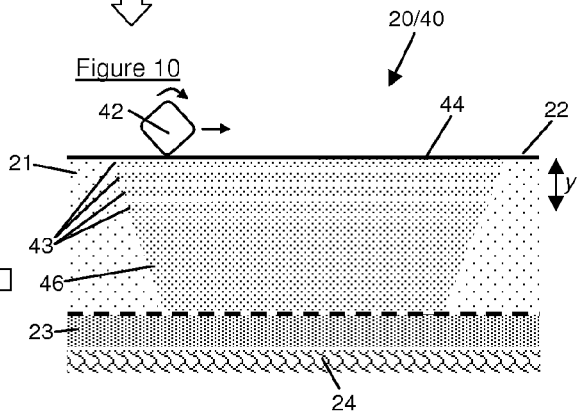

Referring now to FIGS. 7 to 10, the next method step (j) involves repeating the previous cycle of method steps (e) to (h): new layers 43 are added and the newly formed exposed surface 44 compacted under standard compaction 45 until the total thickness y of newly added layers 43 reaches a pre-determined value; rolling dynamic compaction 45 is then applied to the surface 44 of the newly added layers 43 so as to compact them into the compound layer 46; and this cycle is repeated until the excavated site 40 is effectively filled, and the level of the formed surface 44 is substantially equal to the level of the surface 22 of the original site 20, as shown in FIG. 10. In practice, the level of the formed surface 44 is in fact generally 100 mm higher than the surface 22 of the original site 20, to allow for consolidation during the final compaction steps.

Figure 11:
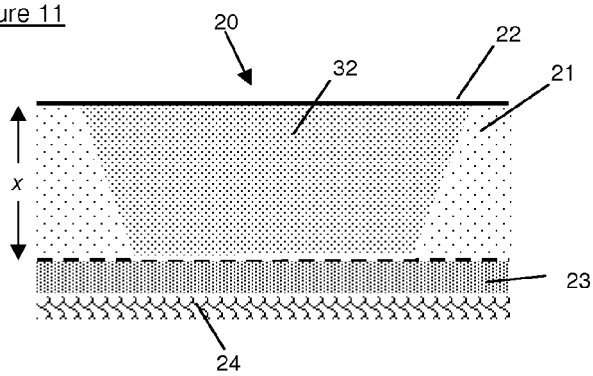

The surface 22/44 of the site 20/40 is then subjected to a final treatment of rolling dynamic compaction 42 so as to compact the new layers 43 and compound layer 46 to form a raft 32 of modified soils, with a depth substantially equal to x as shown in FIG. 11. Any excess material is then trimmed back to the required final surface level 22/44.

The invention claimed is:

1. A method of modifying geotechnically unsuitable soils at a site so as to render the site capable of load bearing, said method comprising the following steps:

(a) excavating a volume of soil from the site, to a pre-determined depth, thereby exposing a base of the excavated site;

(b) applying an in situ soil stabilisation treatment to the base of the excavated site exposed in step (a);

(c) applying a soil stabilisation treatment to the volume of soil excavated from the site in step (a);

(d) applying rolling dynamic compaction to the base of the excavated site exposed in step (a);

(e) re-introducing into the excavated site a portion of the treated soil from step (c) so as to form a layer of pre-determined thickness;

(f) applying compaction to the layer formed in step (e);

(g) iterating steps (e) and (f) to form a compound layer of pre-determined thickness;

(h) applying rolling dynamic compaction to the compound layer formed in step (g); and (j) iterating steps (e) to (h) so as substantially to backfill the site to a pre-determined level;

and wherein in the soil stabilisation treatment in step (b), the base is over-dried such that the base layer then acts as a capillary to absorb any moisture generated during step (d).

2. The method as claimed in claim 1, wherein the soil stabilisation treatments in steps (b) and (c) involve treating said soil with one or more powder or binder materials selected from cement, lime (calcium oxide), pulverised fuel ash (PFA) and ground granulated blast-furnace slag (GGBS).

3. The method as claimed in claim 1 or claim 2, wherein standard compaction is utilised in step (f).

4. The method as claimed in claim 3, wherein the standard compaction in step (f) is continued until substantially 95% compaction of the layer formed in step (e) is achieved.

5. The method as claimed in claim 1, wherein the rolling dynamic compaction in step (h) is continued until effective refusal is achieved.

6. The method as claimed in claim 1, wherein the soil stabilisation treatments in steps (b) and (c) are continued until the moisture content of the treated soil is reduced to substantially 3% less than the standard optimum moisture content for the type of soil being treated.

7. The method as claimed in claim 1, further comprising the preliminary steps of:

(i) investigating the site to determine the soil characteristics;

(ii) determining the building load and design requirements; and (iii) utilising the data from preliminary steps (i) and (ii) to determine required excavation depth for step (a), required composition of the soil stabilisation treatment materials for steps (b) and (c), required layer thickness for step (e), required compound layer thickness for step (g), and required backfill level for step (j).

8. The method as claimed in claim 1, wherein the excavation depth in step (a) is in a range of from 2 m to 5 m.

9. The method as claimed in claim 8, wherein any contaminated materials identified in preliminary step (i) are isolated, modified to prevent leaching, and buried at the base of the site excavated in step (a).

10. The method as claimed in claim 1, wherein the excavation depth in step (a) is substantially 3 m.

11. The method as claimed in claim 1, wherein the layer thickness in step (e) is in a range of from 200 mm to 300 mm.

12. The method as claimed in claim 1, wherein the compound layer thickness in step (g) is in a range of from 1.0 m to 1.5 m.

13. The method as claimed in claim 1, further comprising a supplementary step of:

(iv) testing and monitoring soil condition following each of steps (a) to (j) so as to ascertain and verify consolidation and compaction extent following each method step, and modifying the method appropriately where necessary.

14. The method as claimed in claim 1, wherein the backfill level in step (j) is substantially 100 mm higher than the initial surface level so as to allow for consolidation during subsequent compaction steps.

15. The method as claimed in claim 1, further comprising an additional step of:

(v) following step (d), and prior to step (e), introducing into the excavated site an additional layer having pipes located therein, for connection to a geothermal heating system.

16. The method as claimed in claim 1, wherein soils to be treated include expansive clay soils, and wherein at least one of the soil stabilisation steps include soil modification treatment to prevent subsequent shrinkage and swelling of said expansive clay soils.

* * * * *